US008708835B1

(12) United States Patent
Backman et al.

(10) Patent No.: US 8,708,835 B1
(45) Date of Patent: Apr. 29, 2014

(54) GOLF PUTTER APPARATUS

(71) Applicants: John Backman, Tumwater, WA (US); Clark Tatum, Sacramento, CA (US); Craig William Dye, Puyallup, WA (US); Michael William Slota, Kirkland, WA (US)

(72) Inventors: John Backman, Tumwater, WA (US); Clark Tatum, Sacramento, CA (US); Craig William Dye, Puyallup, WA (US); Michael William Slota, Kirkland, WA (US)

(73) Assignee: The Lazer Putter, LLC, Tumwater, WA (US)

( * ) Notice: Subject to any disclaimer, the term of this patent is extended or adjusted under 35 U.S.C. 154(b) by 0 days.

(21) Appl. No.: 13/868,323

(22) Filed: Apr. 23, 2013

Related U.S. Application Data

(63) Continuation-in-part of application No. 13/595,100, filed on Aug. 27, 2012, now abandoned.

(51) Int. Cl.
*A63B 69/36* (2006.01)

(52) U.S. Cl.
USPC ..... 473/220; 473/221

(58) Field of Classification Search
USPC ..... 473/219–226
See application file for complete search history.

(56) References Cited

U.S. PATENT DOCUMENTS

| | | | | |
|---|---|---|---|---|
| 3,953,034 | A | 4/1976 | Nelson | |
| 5,165,691 | A | 11/1992 | Cook | |
| 5,213,331 | A | 5/1993 | Avanzini | |
| 5,217,228 | A * | 6/1993 | De Aguilar | 473/220 |
| 5,435,562 | A | 7/1995 | Stock et al. | |
| 5,464,221 | A | 11/1995 | Carney | |
| 5,464,222 | A | 11/1995 | Carney | |
| 5,725,440 | A | 3/1998 | Finney | |
| 5,733,202 | A | 3/1998 | Vargo | |
| 7,686,700 | B2 | 3/2010 | Del Raso | |
| 2007/0167248 | A1 | 7/2007 | Fler et al. | |
| 2011/0244975 | A1 | 10/2011 | Farmer et al. | |

FOREIGN PATENT DOCUMENTS

| | | | |
|---|---|---|---|
| KR | 1020000024000 | A | 5/2000 |
| KR | 1020110138913 | A | 12/2011 |

* cited by examiner

*Primary Examiner* — Nini Legesse
(74) *Attorney, Agent, or Firm* — Thomas R. Lampe

(57) ABSTRACT

Golf putter apparatus includes a golf putter, a laser light generator and mirror mounting structure inserted in the shaft maintaining proper positioning of a mirror used to reflect laser light from the laser light generator and operable to hold the mirror in stable fixed position and orientation.

4 Claims, 5 Drawing Sheets

GOLF PUTTER APPARATUS

This application is a continuation-in-part of U.S. patent application Ser. No. 13/595,100, filed Aug. 27, 2012.

TECHNICAL FIELD

This invention relates to golf putter apparatus, more particularly, a golf putter incorporating mechanism for projecting a laser beam from the putter shaft to assist the golfer when putting.

BACKGROUND OF THE INVENTION

A number of systems have been devised over the years for assisting golfers and allow them to make more accurate putts and other golf shots. Some of these devices incorporate structure associated with the club for producing and directing light beams, including laser light beams. The following patent documents are believed to be representative of the current state of the prior art in this particular field: U.S. Pat. No. 5,435,562, issued Jul. 25, 1995, U.S. Pat. No. 5,217,228, issued Jun. 8, 1993, U.S. Pat. No. 5,725,440, issued Mar. 10, 1998, U.S. Pat. No. 5,464,222, issued Nov. 7, 1995, U.S. Pat. No. 7,686,700, issued Mar. 30, 2010, U.S. Pat. No. 5,733,202, issued Mar. 31, 1998, U.S. Pat. No. 5,464,221, issued Nov. 7, 1995, U.S. Pat. No. 5,213,331, issued May 25, 1993, U.S. Pat. No. 5,165,691, issued Nov. 24, 1992, U.S. Pat. No. 3,953,034, issued Apr. 27, 1976, U.S. Patent App. Pub. No. US 2011/0244975, published Oct. 6, 2011, U.S. Patent App. Pub. No. US 2007/0167248, published Jul. 19, 2007, Korean Patent No. KR1020000024000A, issued May 6, 2000 and Korean Patent No. KR1020110138913A, issued Dec. 28, 2011. These devices typically are relatively complex and expensive.

DISCLOSURE OF INVENTION

The golf putter apparatus of the present invention also utilizes a laser beam guide structure in association with a golf club, more particularly a putter. However, the arrangement of the present invention incorporates a number of features not taught or suggested by the prior art which provide a number of practical advantages.

By way of contrast, the putter apparatus of the present invention is comparatively simple and affordable. The components of the present invention are relatively inexpensive and the apparatus can be manufactured utilizing low cost, readily available components.

In addition, the construction of the present invention utilizes modular components which are accessible for ease of replacement or repair, if necessary. The apparatus is also characterized by ease of calibration of the components and protection of operable components inside the putter shaft. The apparatus components can be used with most putter heads and different shafts, including double bend shafts (unlike other laser devices).

The golf putter apparatus of the present invention includes a golf putter including a shaft, a head connected to said shaft and a handle at an upper end of said shaft. The head has a golf ball engagement surface extending relative to said shaft in a lateral direction, and the shaft has an inner surface defining a shaft interior and an elongated aperture communicating with the shaft interior spaced from said head and said upper end and extending longitudinally along a portion of said shaft.

A laser light generator in the shaft interior generates a downwardly directed laser light beam in the shaft interior.

A mirror is located in the shaft interior next to the elongated aperture and is positioned to receive the laser light beam from the laser light generator and reflect the laser light beam through said elongated aperture and outwardly and downwardly therefrom to a location on the around spaced forwardly of the head.

A mirror mounting structure is disposed within the shaft interior, the mirror mounting structure being of elongated configuration and forming an axially extending passageway permitting passage of the laser light beam from the laser light generator to the mirror.

The mirror mounting structure includes a plurality of outwardly extending stabilizing members frictionally engaging the inner surface of the shaft to maintain the mirror mounting structure in a stable fixed position and orientation in the shaft interior.

A manually movable actuator is rotatably connected to the mirror mounting structure for selectively tilting the mirror to position the mirror in alternative angles of inclination, and the mirror is operable to reflect laser light from the laser light generator through the elongated aperture forwardly of the golf ball engagement surface in any of the alternative angles of inclination.

Other features, advantages and objects of the present invention will become apparent with reference to the following description and accompanying drawings.

MODES FOR CARRYING OUT THE INVENTION

Figure 1:
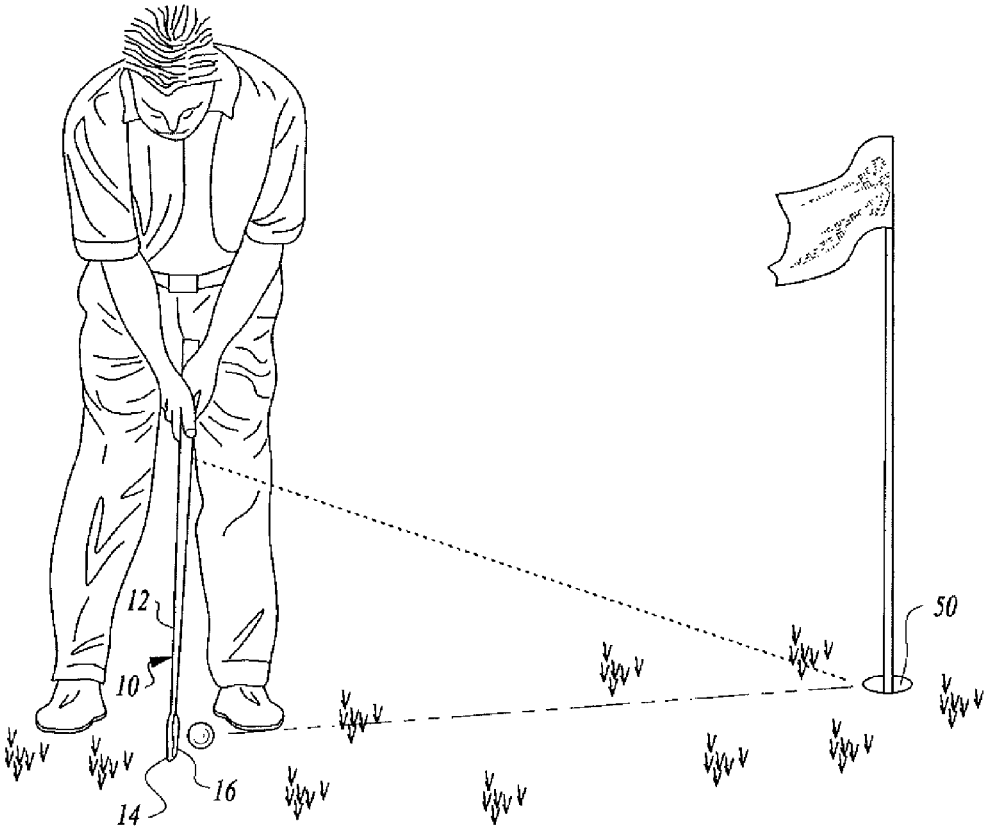
FIG. 1 is a perspective view of the golf putter apparatus being held by a golfer when putting and illustrating schematically by broken lines the path of a laser light beam projecting from the shaft of the club toward a cup and also a representative desired golf ball path on the way toward the cup when a putt is made.

Referring to the drawings, a first embodiment of golf putter apparatus constructed in accordance with the teachings of the present invention is shown in FIGS. 1-10 and is identified by reference numeral 10. The apparatus includes a golf putter having a shaft 12 and a head 14 connected to the shaft. The head, as is conventional, has a golf ball engagement surface 16 extending relative to the shaft in a lateral direction (see FIGS. 1 and 2).

Shaft 12 has a shaft interior 18 and an elongated aperture 20 spaced from and elevated relative to the head and extending longitudinally along a portion of the shaft. In the arrangement illustrated, the shaft 12 is formed of a plurality of shaft sections 22, 24, 26 releasably connected together, for example by screw threads (not shown). The elongated aperture 20 is in the uppermost shaft section 22 having a handle cover 28.

Positioned within shaft sections 24, 26 is a tubular member 30, suitable means, such as a press fit or detents (not shown), being utilized to maintain the tubular member in position but enabling the tubular member to be removed from the shaft interior when desired. See FIGS. 5-9 in particular in this regard.

Located within tubular member 30 is a first surface mirror (also known as a front surface mirror) identified by reference numeral 34. The first surface mirror 34 is affixed to a mounting member 36 with the front or first surface thereof disposed outwardly. An axle 38 rotatably connects the mounting member 36 to the tubular member 30 with the mounting member and first surface mirror disposed within the tubular member, as illustrated. It is to be noted that the tubular member has an opening 40 adjacent to the elongated aperture 20 defined by the shaft, the opening 40 being larger than the elongated aperture 20.

Figure 2:
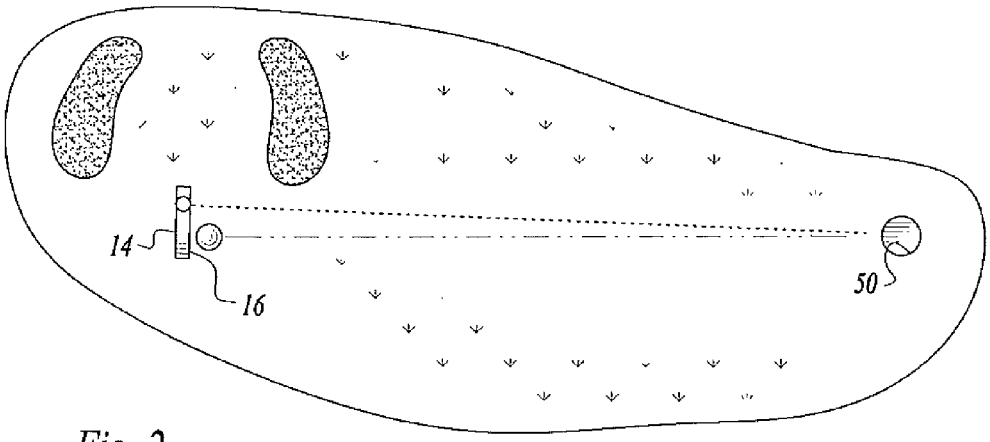
FIG. 2 is a schematic, plan view illustrating relative placement of the golfer's feet, the putter head, the projected laser beam and golf ball with desired golf ball path toward the cup.
Figure 3:
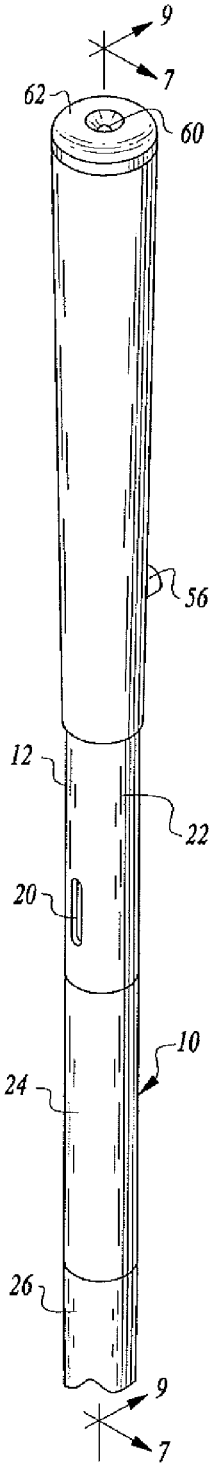
FIG. 3 is an enlarged, perspective view illustrating an upper end portion of the golf putter apparatus.
Figure 4:
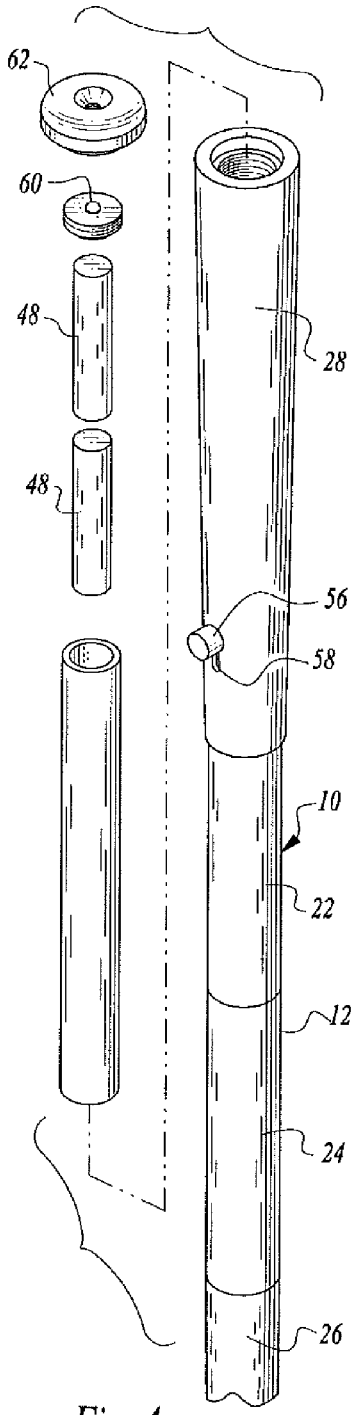
FIG. 4 is an exploded, perspective view of the golf putter portion shown in FIG. 3 with certain structural elements, including laser light generator elements, disassembled.
Figure 5:
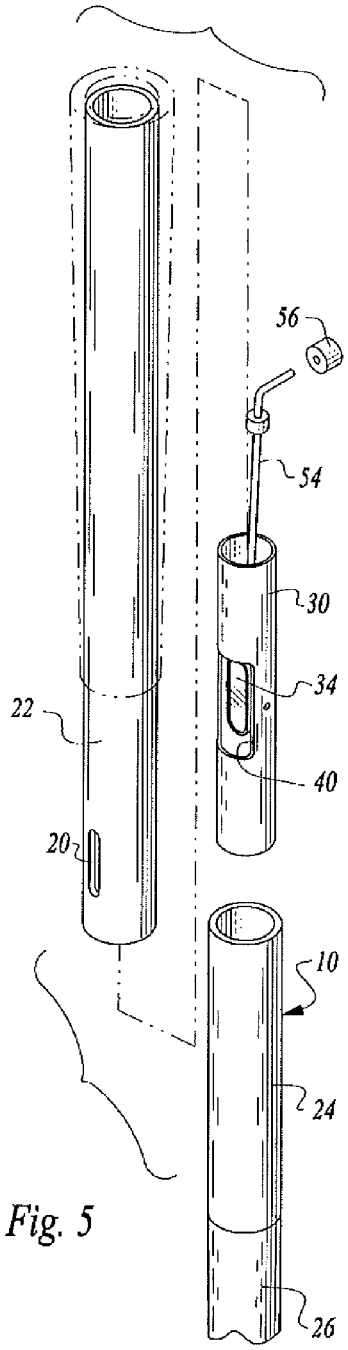
FIG. 5 is an exploded, perspective view illustrating additional disassembled components including mirror mounting and adjustment components, of the golf putter apparatus.

Located within the interior of shaft 12 and more specifically within shaft section 22 above the mounting member 36 and first surface mirror 34 as well as above the tubular member 30 forming a module incorporating the mirror and mounting member, is a green laser light generator 46 which suitably may be an off the shelf green laser pointer. Batteries 48 (FIG. 4) are employed to power the green laser pointer. A green laser light beam generated by the green laser light generator 46 is received by the first surface mirror and reflected thereby through both opening 40 and elongated aperture 20 to a location spaced from the golf putter head. Broken lines in FIGS. 1, 2 and 7-10 illustrate the direction of the green laser light beam. In FIGS. 1 and 2, the target of the green laser light beam is a position on the ground in front of the cup 50.

A manually movable actuator is operatively associated with the mirror mounting member to selectively tilt the first surface mirror to position the first surface mirror in alternative angles of inclination. The first surface mirror is operable to reflect green laser light through the aperture 20 in a direction orthogonal to the lateral direction of the golf ball engagement surface in any of the alternative angles of inclination.

It is desirable to use a green laser light generator since green is the color most visible to the human eye in daylight conditions. Because the mirror 34 is a first or front surface mirror, placement of the light beam is extremely accurate, the light beam not being diffused as would be the case if using a conventional rear reflecting surface mirror.

Figures 6, 7, 8, 9, 10:
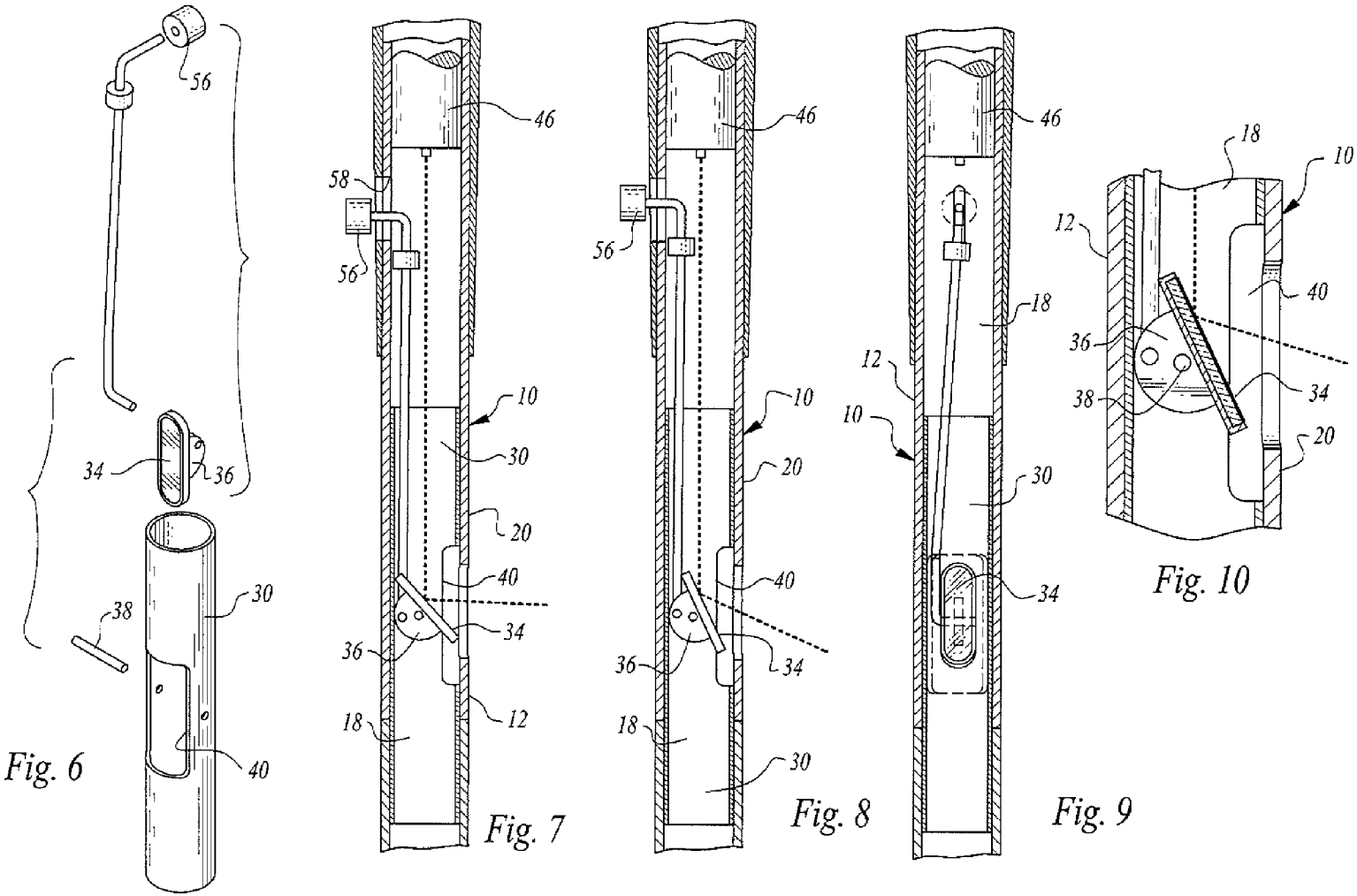
FIG. 6 is a perspective view illustrating details of mirror mounting structure and a manually movable actuator of the apparatus.
FIG. 7 is a cross-sectional view illustrating certain components of the golf putter and taken along the line 7-7 of FIG. 3.
FIG. 8 is a view similar to FIG. 7, but illustrating the first surface mirror in a different angle of inclination caused by the mirror mounting structure and manually movable actuator of the apparatus.
FIG. 9 is an enlarged, cross-sectional view taken along the line 9-9 of FIG. 3.
FIG. 10 is an enlarged, cross-sectional view illustrating details of the mirror mounting structure, the first surface mirror, and manually movable actuator.
Figure 11:
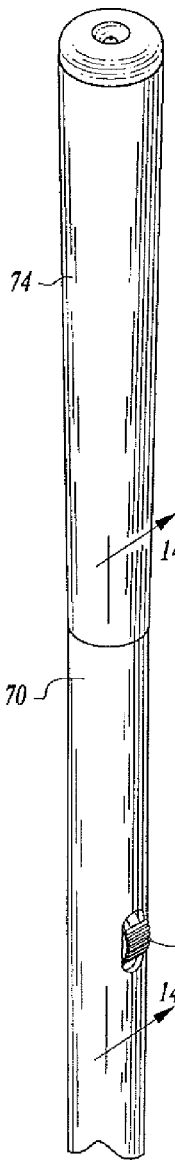
FIG. 11 is a view similar to FIG. 1 illustrating an alternative embodiment of the invention.
Figure 12:
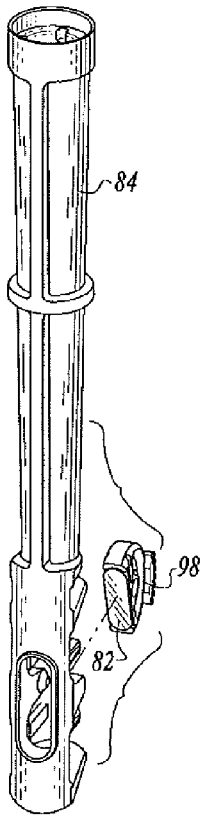
FIG. 12 is an exploded, perspective view of a mirror and mirror mounting structure of the alternative embodiment.

The manually movable actuator of the invention includes a control rod 54 extending within the shaft interior and connected to the mounting member 36. A manually engageable projection or member 56 is attached to the control rod at a location spaced from the mounting member 36 and extends through a slot 58 formed in shaft section 22 and handle cover 28. FIGS. 7 and 8 show alternative positioning of the control rod and corresponding change of inclination of the first surface mirror.

Also incorporated in the golf putter apparatus is a recessed electrical switch 60 which is a part of the green laser pointer. Switch 60, being recessed within the confines of a handle end cap 62, prevents accidental activation by the green pointer to which it is operably connected in a known fashion. The pointer can readily be turned on or off however by a user's thumb or other finger upon application of sufficient pressure.

Figure 15:
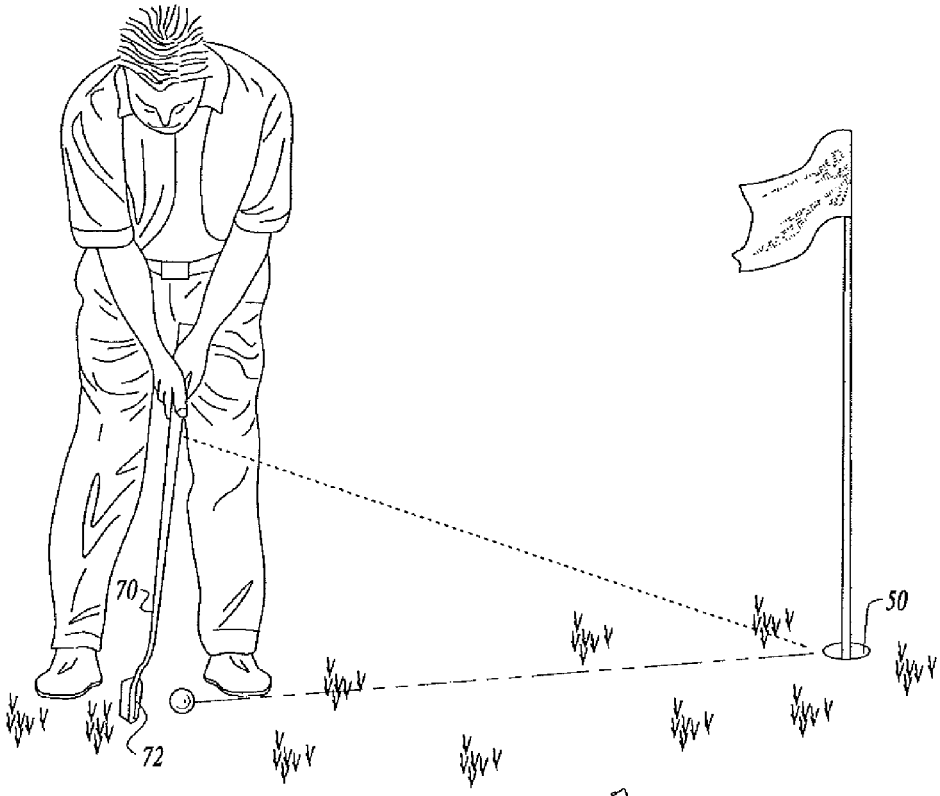
FIG. 15 is a view similar to FIG. 1 showing use of a double bend putter by a golfer.
Figure 17:
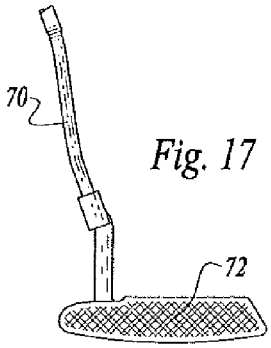
FIG. 17 is an enlarged, frontal view of the double bend putter head and lower shaft portion connected to the putter hosel.
Figure 16:
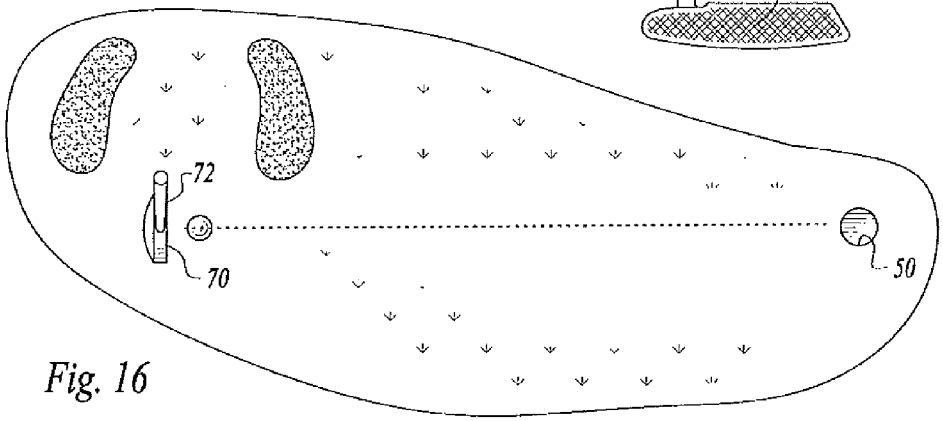
FIG. 16 is a schematic plan view illustrating alignment of a laser light beam projected by the apparatus of the present invention relative to a cup and shaft and head of the double bend putter.

FIGS. 11-17 show an alternative embodiment of the invention. In this embodiment the golf putter apparatus includes a golf putter including a shaft 70 (which may be a double bend putter shaft as illustrated in FIGS. 15 and 16), a head 72 connected to the shaft and a handle 74 at the upper end of the shaft.

The head has a golf ball engagement surface extending relative to the shaft in a lateral direction.

The shaft has an inner, cylindrically-shaped surface 76 defining a shaft interior and defines an elongated aperture 78 communicating with the shaft interior spaced from the head and the shaft upper end. The elongated aperture 78 extends longitudinally along a portion of the shaft below the handle.

A laser light generator 8 which is suitably a battery operated green laser pointer is located in the shaft interior for generating a downwardly directed green laser light beam in the shaft interior.

A first surface mirror 82 is located in the shaft interior next to the elongated aperture 78 and is positioned to receive the laser light beam from the laser light generator and reflect the laser light beam through the elongated aperture and outwardly and downwardly therefrom to a location on the ground spaced forwardly of the head. The light beam is shown by dash lines in FIGS. 14-16.

Mirror mounting structure 84 is located within the shaft interior. The mirror mounting structure illustrated is suitably of single-piece, molded plastic construction. The mirror mounting structure is of elongated configuration and forms an axially extending passageway therethrough along the length thereof permitting passage of the laser light beam from the laser light generator to the mirror.

The mirror mounting structure 84 includes a plurality of outwardly extending stabilizer members 86, 88, 90, 92, and 94 which frictionally engage the inner surface of the shaft to maintain the mirror mounting structure in a stable fixed position and orientation in the shaft interior. It is to be noted that stabilizer member 86 comprises part of a receptacle supporting the laser light generator with the laser light generator firmly held within the receptacle to prevent relative movement between the laser light generator and the mirror mounting structure with the laser light generator pointed toward the mirror.

Also, stabilizer member 92 is shaped to protrude outwardly and enter the elongated aperture 78 and engage the portion of the shaft defining the elongated aperture. The illustrated stabilizer member 86 has an oval configuration conforming to the shape of the elongated aperture to provide a firm continuous fit therebetween and correctly position and orient the mirror mounting structure and mirror in precise operative condition.

The golf putter apparatus also includes a rotatable manually movable actuator 98 for selectively tilting the mirror to position the mirror in alternative angles of inclination, the mirror being operable to reflect laser light from the laser light generator through the elongated aperture forwardly of the golf ball engagement surface in any of the alternative angles of inclination.

The manually movable actuator 98 has a first outer peripheral segment 100 disposed within the axially extending passageway of the mirror mounting structure, the mirror affixed thereto with the reflective first surface thereof closely adjacent to and facing the elongated aperture 78.

Shaft 70 defines a slot 102 at a shaft location opposed to the location of the elongated aperture 78. The manually movable actuator 98 projects through the slot and has a manually engageable second outer peripheral segment disposed externally of the shaft to allow selective manual rotation of the manually movable actuator to change the inclination of the mirror. In this embodiment, the manually engageable second outer peripheral surface comprises a knob 104 having a non-smooth outer surface to prevent finger slippage.

Figure 13:
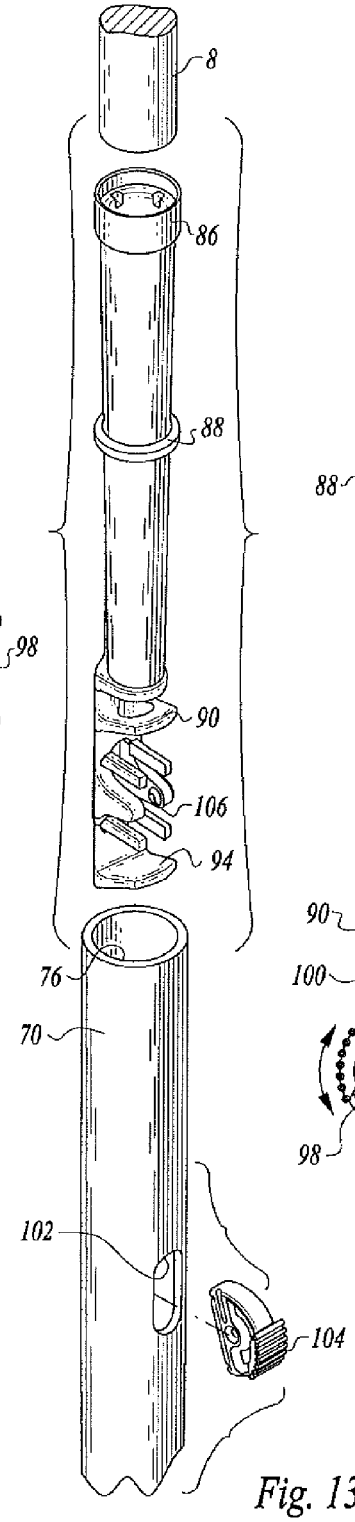
FIG. 13 is an exploded, perspective view illustrating a shaft segment, a club handle, elements of the mirror mounting structure, and mirror of the alternative embodiment prior to assembly.
Figure 14:
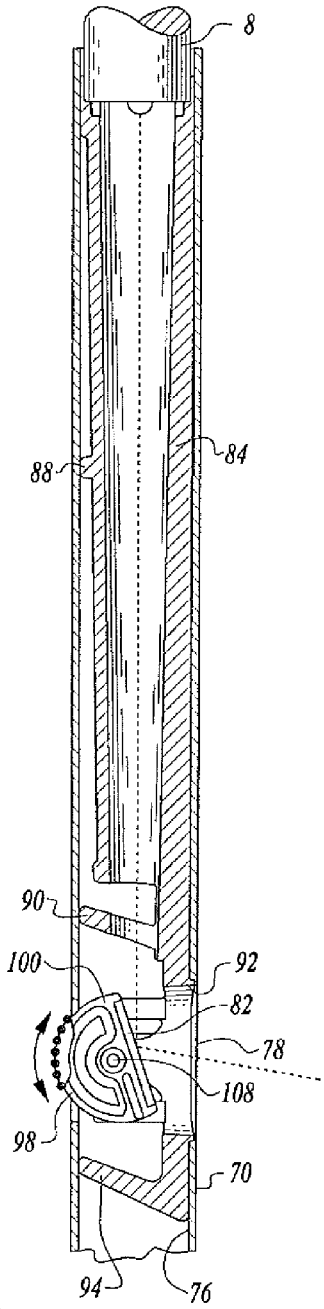
FIG. 14 is an enlarged, cross-sectional view taken along line 14-14 of FIG. 11.

The mirror mounting structure 84 includes spaced detents 106, only one of which is illustrated (in FIG. 13). The detents are received in indents 108 of the manually movable actuator 98 to allow manual rotation of the manually movable actuator. Frictional engagement of the indents and the detents should be sufficient to allow the manually movable actuator to remain in place relative to the mirror mounting structure when no outside force is applied to the knob 104. Supplemental means also may be employed for such purpose.

The invention claimed is:

1. Golf putter apparatus comprising, in combination:

a golf putter including a shaft, a head connected to said shaft and a handle at an upper end of said shaft, said head having a golf ball engagement surface extending relative to said shaft in a lateral direction, and said shaft having an inner surface defining a shaft interior and an elongated aperture communicating with the shaft interior, spaced from said head and said upper end and extending longitudinally along a portion of said shaft;

a laser light generator in said shaft interior for generating a downwardly directed laser light beam in said shaft interior;

a mirror having a reflective first surface in said shaft interior next to said elongated aperture and positioned to receive the laser light beam from said laser light generator and reflect said laser light beam through said elongated aperture and outwardly and downwardly therefrom to a location on the ground spaced forwardly of said head;

mirror mounting structure within said shaft interior, said mirror mounting structure of unitary construction and elongated configuration and forming an axially extending passageway permitting passage of the laser light beam from said laser light generator to said mirror, said mirror mounting structure including a plurality of spaced, outwardly extending stabilizing members frictionally engaging the said shaft at lengthwise spaced locations of said shaft, one of said stabilizing members projecting into said elongated aperture to maintain the mirror mounting structure in said shaft interior and in a stable fixed position and orientation relative to said shaft; and a manually movable actuator rotatably connected to said mirror mounting structure by cooperating indents and detents thereon for selectively tilting said mirror to position said mirror in alternative angles of inclination, and the mirror operable to reflect laser light from said laser light generator through said elongated aperture forwardly of said golf ball engagement surface in any of said alternative angles of inclination, said manually movable actuator having a first outer peripheral segment disposed within said axially extending passageway having said mirror affixed thereto with the reflective first surface thereof closely adjacent to and facing said elongated aperture, said shaft defining a slot at a shaft location opposed to the location of said elongated aperture, and said manually movable actuator projecting through said slot and having a manually engageable second outer peripheral segment disposed externally of said shaft to allow selective manual rotation of said manually movable actuator to change the inclination of said mirror, said mirror mounting structure additionally including a receptacle supporting said laser light generator with said laser light generator firmly held within the receptacle to prevent relative movement between said laser light generator and said mirror mounting structure with the laser light generator pointed toward said mirror and laser light from the laser light generator passing through the axially extending passageway of said mirror mounting structure.

2. The golf putter apparatus according to claim 1 wherein said laser light generator is a green laser light generator.

3. The golf putter apparatus according to claim 1 wherein said mirror mounting structure is of single-piece, molded plastic construction.

4. The golf putter apparatus according to claim 2 wherein said green laser light generator is a battery operated green laser pointer.

* * * * *